US005819831A

United States Patent [19]

Schanz

[11] Patent Number: 5,819,831

[45] Date of Patent: Oct. 13, 1998

[54] ROLLER BLIND DRIVE, MORE PARTICULARLY FOR SHADE PRODUCING MEANS

[76] Inventor: Hans Schanz, Schulweg 5, 72226 Simmersfeld, Germany

[21] Appl. No.: 758,811

[22] Filed: Dec. 4, 1996

[30] Foreign Application Priority Data

Dec. 22, 1995 [DE] Germany ..... 195 48 263.8

[51] Int. Cl.[6] ..... E06B 9/08

[52] U.S. Cl. ..... 160/133; 160/242; 242/399

[58] Field of Search ..... 160/133, 242, 160/23.1; 242/399, 399.1, 592

[56] References Cited

U.S. PATENT DOCUMENTS

| | | | |
|---|---|---|---|
| 715,816 | 12/1902 | Kinnear | 160/242 X |
| 1,081,202 | 12/1913 | Brunst | 160/133 |
| 1,367,240 | 2/1921 | Cornell | 160/133 X |
| 1,489,551 | 4/1924 | Smith | 160/242 |
| 1,825,198 | 9/1931 | Negrini | 160/242 |
| 3,237,682 | 3/1966 | Davis | 160/269 |
| 3,698,346 | 10/1972 | Bauer | 160/133 X |
| 5,540,269 | 7/1996 | Plumer | 160/310 X |
| 5,544,690 | 8/1996 | Magro et al. | 160/271 X |

FOREIGN PATENT DOCUMENTS

| | | | |
|---|---|---|---|
| 65054 | 7/1942 | Norway | 160/242 |

*Primary Examiner*—Blair Johnson
*Attorney, Agent, or Firm*—Browdy and Neimark

[57] ABSTRACT

A roller blind drive comprising a roller blind member running along an oblique area to be shaded and a motor-driven and rotatably mounted winding shaft onto and from which the roller blind member may be wound and unwound. The winding shaft is mounted in a sliding manner at each end in respective guide tracks, which in the assembled state extend obliquely downward. The displacement of the winding shaft due to gravity in a downward direction is limited by a guide shoe element arrangement, the roller blind member unwound from the winding shaft being guided along such guide shoe element arrangement toward the oblique area. Owing to the gravity-related displacement of the winding shaft same will at all times have the respectively wound up coil of the roller blind member in engagement with the said guide shoe element arrangement so that during unwinding the roller blind member will be unwound along such guide shoe element arrangement and thrust outward, high thrusts being able to be produced, which render possible extremely small angles of slope of down to essentially 5°. The roller blind drive is consequently particularly well suited for shading purposes FIG. 1.

13 Claims, 2 Drawing Sheets

FIG. 7
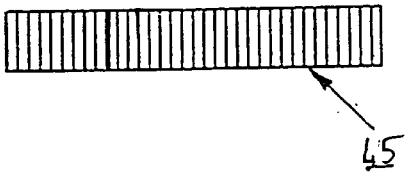
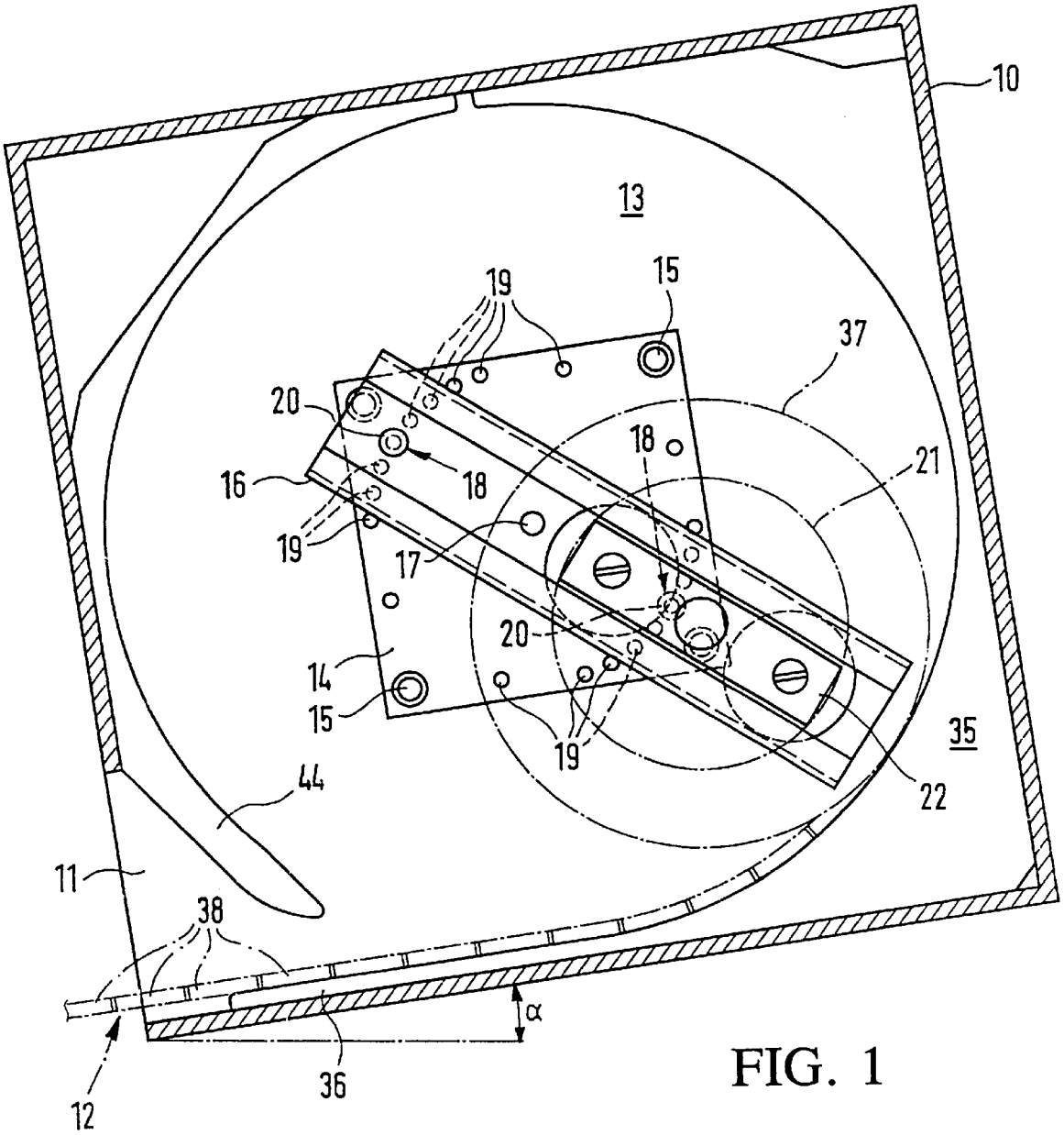
FIG. 1

ROLLER BLIND DRIVE, MORE PARTICULARLY FOR SHADE PRODUCING MEANS

BACKGROUND OF THE INVENTION

The invention relates to a roller blind drive more particularly for shading devices, comprising a roller blind member, means for guiding said roller blind member along an oblique area to be shaded, and a motor-driven rotatably mounted winding shaft from and onto which said blind member may be wound.

THE PRIOR ART.

In the case of vertically running roller blinds fitted to windows or the like the unwinding operation does not give rise to any problems, since the roller blind will move downward during unwinding under gravity. If however the roller blind is to run along an oblique area the effect of gravity will be reduced with every reduction in the angle to the horizontal so that unwinding will become increasingly problematical. In order to overcome this difficulty there has already been a proposal in the German patent publication 4,100,609 to aid in the unwinding operation by using a draw cable, which running over a cable guide device is additionally driven by the drive motor. Moreover there has already been a proposal in the past to aid the unwinding operation by having additional friction or gear wheels acting on the roller blind member. All these measures however involve substantially more technical complexity and greater costs owing to the additionally provided drive means, there also being a sacrifice as regards the appearance of the device. A further point is that there is an increased need for servicing and an increased proneness to failure, since such roller blind drives, for instance for shades, are conventionally mounted on the exterior of buildings.

SHORT SUMMARY OF THE INVENTION

One object of the invention is to provide a roller blind drive, with which only the winding shaft is driven and in which no other drive mechanisms are required, which nevertheless ensures a trouble-free unwinding operation even when the area served by the roller blind is at an extremely small angle to the horizontal.

In order to achieve these and/or other objects appearing from the present specification, claims and drawings, in the instant invention there is the provision of guide tracks at the ends of the winding shaft for sliding movement of the winding shaft, such tracks extending in the assembled state obliquely downward and of a guide shoe element arrangement for limiting the displacement of the winding shaft downward owing to gravity, the roller blind member being guided along such guide shoe element arrangement toward the oblique area during unwinding of the roller blind member from the winding shaft.

Owing to the sliding guide in the guide tracks the winding shaft will, whatever the diameter of the more or less wound up coil of roller blind member thereon, always be contact with the guide shoe element arrangement under the action of gravity so that during unwinding the roller blind member will remain directly tangentially in contact with this said guide shoe element arrangement and Will be guided along same toward the oblique area. Accordingly a sufficient thrust force will be exerted on the roller blind member in the course of being unwound so that the blind's unwinding action will be reliable even at extremely small slopes of the oblique area to the horizontal of for example 5°. The features of mechanical design necessary for this are simple and may be adopted at low cost. The unwinding operation takes place without any trouble both with the roller blind member completely wound up and also with it practically fully unwound.

Further advantageous developments of and improvements on the roller blind drive are defined in the claims.

The guide shoe element arrangement preferably comprises at least two guide shoe elements similar to disk cams, which are arranged in the axial positions of the marginal portions of the winding shaft, there being if desired in the case of long winding shafts additionally at least one third guide element for supporting and guiding the axial middle portion. These guide shoe elements similar to a disk cam may be relatively narrow in design so that despite there being a satisfactory guide action there is only a small amount of friction between the elements and the roller blind member.

For additionally aiding the unwinding operation the roller blind member can be marginally provided with frictional land/or tooth elements for holding the layers of its coil in relation to one another, such elements being more especially in the form of male elements able to be fitted marginally into the hollow slats of the roller blind member or in the form of strip-like frictional layer elements formed on the roller blind member. These frictional and/or tooth elements may be advantageously made of elastic material with a high coefficient of friction and/or may have teeth or grooves extending athwart the direction of winding. On winding up the roller blind member onto the winding shaft the frictional and/or tooth elements of the separate layers will abut each other, the high coefficient of friction of the elastic material and/or the teeth or grooves effectively precluding relative displacement of the layers during unwinding. Accordingly it becomes possible for the force of the driven winding shaft to act directly on the roller blind member moving tangentially away from the winding shaft. Last but not least, it is then possible for areas to be shaded having an extremely small angle to the horizontal to be fitted with such roller blind drives.

The frictional and/or toothed elements may not axially overlap the guide shoe element arrangement and must in fact extend adjacent to same in order to have a low coefficient of friction at such guide shoe element arrangement.

The slope of the guide tracks is able to be reset in accordance with the slope of the oblique area by means of a slope setting means, since for every slope of the oblique area a predetermined, corresponding slope of the guide track has been found to be optimum.

A structure with a simple mechanical design for acting as a suitable slope setting means may be such that the guide tracks, constituted by guide rails, are pivotally mounted on holding elements more particularly in the form of holding plates, rows of holes or slots being provided on the holding elements for adjustment of the slope angle of the guide tracks so that a simple bolt, rivet or screw means may be employed for fixing the guide rail at a predetermined angle of slope.

It is preferred for the holding elements to be attached at both ends of a roller blind casing. In this case the guide shoe elements of the guide shoe element arrangement are arranged clear of the ends of the roller blind in the same and also contribute to the mechanical strength of the roller blind casing. The guide shoe elements may then with advantage open at a through slot in the roller blind casing so that there is a continuous guide action for the roller blind member as far as such through slot.

As a simple, low-cost and sturdy mechanical design for making sliding of the winding shaft possible, at its two ends holding means provided with wheels are arranged, the wheels respectively running in the guide track, which may more especially be in the form of an open channel so that the wheels may only be moved, with minimum friction, in the direction of sliding.

One of the two holding means is preferably linked via a rotary bearing with the winding shaft and the other holding means is connected in such a manner as to prevent relative rotation with the drive shaft or the housing of a drive motor arranged within the winding shaft.

One embodiment of the invention is represented in the accompanying drawings and will be explained in more detail in the following with reference thereto.

LIST OF THE SEVERAL VIEWS OF THE FIGURES.

FIG. 1 is a cross sectional view of a roller blind casing in the case of which on the inner side of one end a holding plate connected with a guide rail will be seen.

FIG. 7 shows a view similar to FIG. 5 showing an alternative embodiment of the frictional elements.

Figure 2:
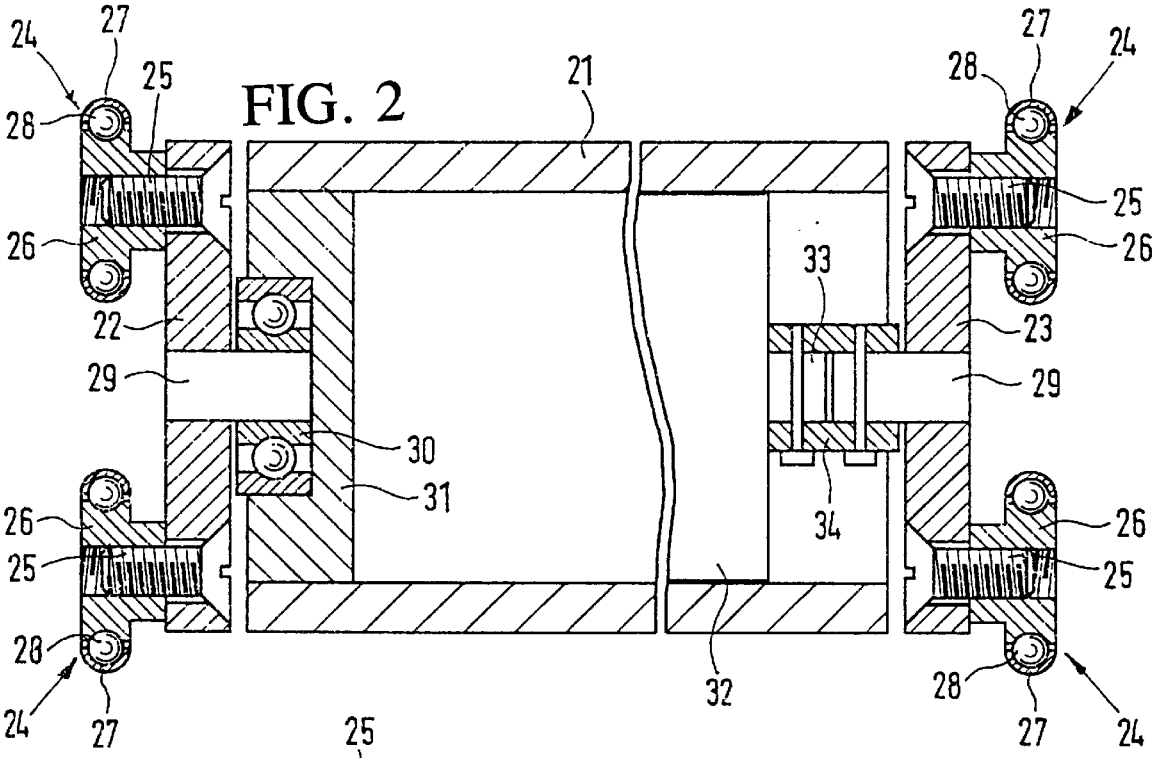
FIG. 2 is a longitudinal sectional view taken through a winding shaft provided at either end with holding means and wheels.

DETAILED ACCOUNT OF WORKING EMBODIMENT OF THE INVENTION.

In the case of the working embodiment of the invention illustrated in FIG. 1 a roller blind casing 10 has a substantially square cross section and possesses a slot-like opening 11 extending in the longitudinal direction thereof and through which a roller blind member 12 or blind element may be run out of the roller blind casing 10. The above described roller blind drive is more especially suitable as for a shade or for shading device, with which window areas or glass roofs are to be shaded, which are set at a relatively small angle $\alpha$ to the horizontal. The roller blind drive of the invention is capable of operating at slope angles as small as 5°.

On the internal faces of the two end walls 13 of the roller blind casing 10 there is a respective holding plate 14, which is secured in place by means of screws 15 or other fastening means. At each holding plate 14 a guide rail 16 is pivotally mounted for rocking about a shaft 17, such guide rail 16 having the form of an angular channel open on one side. From the shaft 17 there extends a short part of the guide rail 16 obliquely upward, whereas a longer part extends obliquely downward into the a part, remote from the opening 11, of the roller blind casing 10. For adjustment to a desired angle of slope of the guide rail 16 a slope adjustment device is employed. The same is in the form of two through slots 18 in the guide rail 16 on each side of the shaft 17 and two rows of setting holes 19 in the holding plates 14, which are arranged in a circle around the shaft 17 and which are set at the same distance from it as the through holes 18. For adjustment to the desired angle of slope the through holes 18 are aligned with two of the setting holes 19 at the desired angle of slope and by means of screws 20, bolts or rivets, are fixed in this position. For changing the set angle of slope the screws 20 are slackened off, a new angle of slope is moved to and the screws 20 are reinserted through, and re-screwed into, the through holes 18 and the setting holes corresponding to the new angle of slope. Other known slope setting devices may naturally be utilized for this purpose as well.

A cylindrical winding shaft 21 is, as shown in FIG. 2, provided at either end with rod-like holding means 22 and 23, which extend athwart the longitudinal axis of the winding shaft 21 and at their end parts bear wheels 24 turned away from the winding shaft 21. These wheels 24 or rollers each comprise a support body 26 carried to the respective holding means 22 and 23 by means of holding screws 25, a ring body 27 being rotatably mounted on each support body 26 by the intermediary of bearing balls 28. The holding means 22 indicated on the left hand side in FIG. 2 is rotatably mounted by means of a bearing 30 secured in the winding shaft 21 and carried on a central shaft 29. The bearing 30 is in this case secured in the interior of the winding shaft in a holding body 31. In the opposite right hand end part of the winding shaft 21 an electric drive motor 32 is mounted and secured in place, same only being illustrated in part. At this end the central shaft 29 of the holding means 23 is connected in such a manner as to prevent relative rotation with a drive shaft 33 of the drive motor 32. For this purpose there is a coupling piece 34. As an alternative to this it is possible as well to connect the housing of the drive motor 32 with the holding means 23 in such a manner as to prevent relative rotation, for instance by screwing it to the latter, whereas the drive shaft 33 directed into the interior of the winding shaft is connected by means of a dog with the winding shaft 21 in such a manner as to prevent relative rotation.

Figure 3:
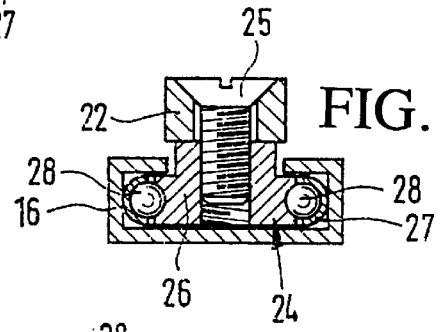
FIG. 3 is a cross sectional view of a guide rail with a wheel secured thereto.
Figure 6:
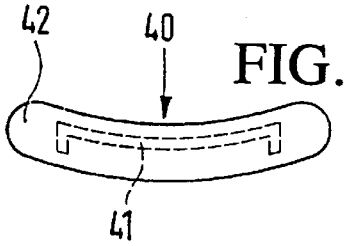
FIG. 6 shows a side view of such a frictional and tooth element as in FIG. 5 looking in the direction of arrow A.

The winding shaft 21 is so arranged inside the roller blind casing 10 that the wheels 24 arranged at the opposite end parts run respectively in pairs in the guide rails 16, as shown in FIG. 3 and furthermore indicated in FIG. 1. It is in this manner that the winding shaft 21 may be displaced in the roller blind casing 10 along the guide rails 16. Owing to gravity the winding shaft 21 is however urged along the downwardly sloping guide rails 16 and will assume the lowermost position. This lowest possible position is set by two dislike guide shoe elements 35, similar to cam disks, which are respectively set in place in the roller blind casing 10 at a distance from the two end walls 13 of the roller blind casing 10 and in parallelism to such end walls 13. These guide shoe elements 35 possess a circularly arcuate inner face or edge facing the winding shaft 21 which is convex as is clearly seen in FIG. 1, the circular curvature smoothly merging into a linear part 36 leading to the opening 11. The coil 37, which is respectively wound on the winding shaft 21, of the roller blind member 12 is thus, owing to the action of gravity, kept riding on the two guide shoe elements 35 at all times.

Figure 4:
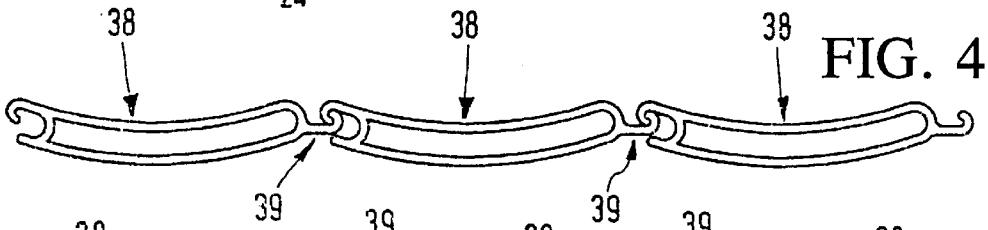
FIG. 4 is an end-on view of a roller blind member comprising shafts in meshing engagement with each other, only three slats being illustrated.
Figure 5:
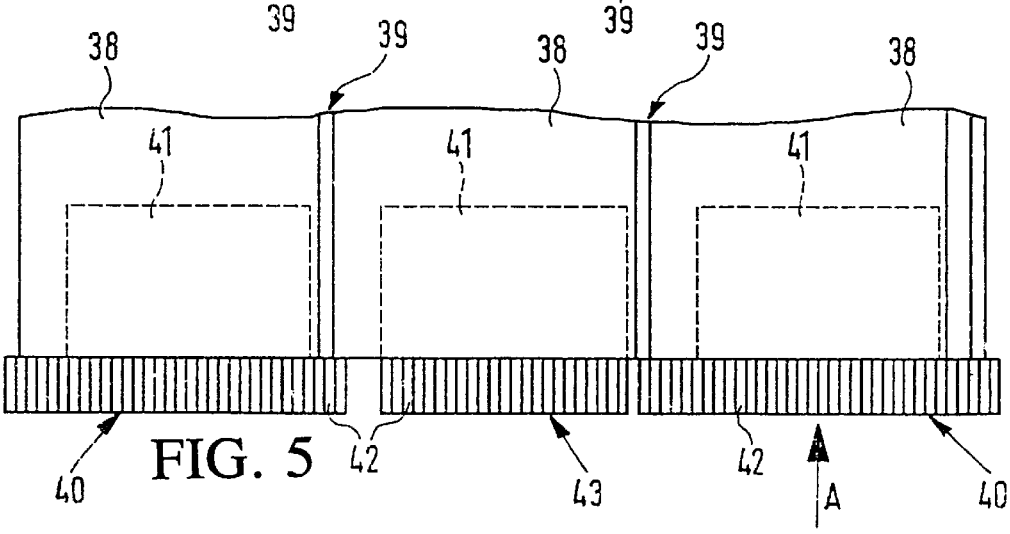
FIG. 5 is a plan view of the marginal part of the slats depicted in FIG. 4, the frictional and tooth elements being inserted into the cavities in the slats.

The roller blind member 12 comprises in a known fashion a train of parallel slats 38 which are hooked together by means of longitudinal hook-section flanges as shown in FIG. 4. The slats 38 are, also in a known manner, in the form of hollow sections. In order to preclude relative longitudinal displacement of the slats 38 the same have, in a known fashion, end male elements 40, whose respective inserted part 41 is run into such a cavity, the outer part 42 somewhat overlapping the adjacently placed slat 38. Smaller male elements 43 are in this design respectively placed between two overlapping male elements 40 or, respectively, inserted in the respective slat 38. The outer parts 42 of the male elements 40 and 43 have teeth or grooves extending in parallelism to the longitudinal direction of the slats 38. Furthermore the male elements 40 and 43 are manufactured of an elastic material with a high coefficient of friction, it however being possible for only one of these measures to be provided. During winding up the roller blind member 12 the male elements 40 and 43 of sequentially placed layers of the roller blind member 10 come into contact with one another, the grooves or teeth and/or the high coefficient of friction being responsible for mutual locking of the layers so that displacement of the layers or turns of the roller blind member is prevented. Here and in the following claims, "frictional" refers to anti-sliding force provided by elastic material, by toothed elements, or by teeth or grooves extending perpendicularly to the direction of winding.

Instead of the above described male elements of elastic material for locking the relative positions of the layers it is also possible to provide strip-like layers 45 of frictional or non-slip elastic material, same also being provided with grooves or ridges if desired FIG. 7. The individual frictional strip elements on the slats are in turn responsible for a relative locking together of the layers of the coiled up roller blind member and prevent displacement of the layers in relation to each other.

If in the position illustrated in FIG. 1 of the winding shaft 21 (which is only indicated diagrammatically) with the wound up coil 37, the drive motor 32 is turned on in the unwinding direction, the winding shaft 21 will rotate together with the coil 37 gathered up on it, and the roller blind member 12 will be moved away from the winding shaft 21 toward the opening 11 along the guide shoe elements 35 with the result that as a consequence of the tooth male elements 40 and 43 (or frictional strip elements) a high thrust force will be produced, which also permits the above mentioned low angles a of slope. The roller blind member 12 is the while guided in a known manner along the area to be shaded at the edge in guides which are not illustrated. During unwinding the winding shaft 21 will be displaced, owing to the reduction in size of the wound coil 37, along the guide rails 16 toward the guide shoe elements 35. Reverse motion of the winding shaft 21 along the guide rails 16 will take place during winding up owing to the increase in size of the coil 37.

The adjustment of the slope of the guide rails 16 will be dependent, to fair extent, on the angle a of slope and will be optimized in accordance with individual requirements.

The guide shoe elements 35 must be in each case arranged at least so far from the end walls 13 of the roller blind casing 10 that the male elements 40 and 43 do not have their grooved and/or non-slip faces in sliding engagement with them and there is contact with the smooth parts of the slats 38. In the case of extremely long winding shafts 21, that is to say in the case of extremely wide roller blind members, an additional guide shoe element 35 or a plurality of additional guide shoe elements 35 may be arranged in the middle part of the roller blind casing 10 in order to preclude sagging of the winding shaft 21.

Instead of the holding plates 14 it is naturally possible to provide differently shaped holding elements, or the guide rails 16 may be adjustably secured on the end walls 13 of the roller blind casing 10.

A part 44, which is integral or, in accordance with FIG. 1, is separate, of the guide shoe elements 35 completes the inner edge or face thereof to form an almost complete circle, an end part fitting downward into the slot-like opening 11 and only permitting a limited amount of upward lift of the roller blind member clear of the linear part 36 of the guide shoe elements 35.

I claim:

1. A roller blind drive comprising a roller blind member, means for guiding said roller blind member along an oblique area to be shaded, a motor-driven rotatable mounted winding shaft from and onto which said blind member may be wound, guide tracks at the ends of the winding shaft for sliding movement of the winding shaft, such tracks extending in the assembled state obliquely downward and a guide shoe element arrangement for limiting the displacement of the winding shaft downward owing to gravity, the roller blind member being guided along such guide shoe element arrangement toward the oblique area during unwinding of the roller blind member from the winding shaft;

wherein the slope of the guide tracks may be adjusted in a manner dependent on the slope of the oblique area by means of a slope setting device; and wherein the guide tracks in the form of guide rails are pivotally mounted on holding elements, which are more especially designed in the form of holding plates, rows of holes or of slots being provided in the holding elements for adjustment of the angle of slope of the guide tracks.

2. The roller blind drive as claimed in claim 1, wherein the holding elements are attached to the two ends of a roller blind casing.

3. The roller blind drive as claimed in claim 2, wherein the elements of the guide shoe element arrangement are arranged spaced from the ends of the roller blind casing in same.

4. The roller blind drive as claimed in claim 3, wherein the elements of the guide shoe element arrangement open at a through slot in the roller blind casing.

5. A roller blind drive device with unwinding thrust force, the device comprising:

a motor-driven winding shaft, rotatable in an unwinding direction, the winding shaft having a motor and ends;

a roller blind member wrappable around the winding shaft in a coil;

a curved guide shoe element adjacent and pressed against the coil;

whereby the winding shaft is turnable in the unwinding direction to unroll the roller blind member therefrom while maintaining the roller blind member in contact with the curved shoe element, such that buckling of the roller blind element is prevented in the coil and on the guide shoe element;

wherein the coil is pressed against the guide shoe element by guide tracks engaging the ends of the winding shaft, the winding shaft being slidable along the guide tracks toward and away from a guide shoe element.

6. A roller blind drive comprising a roller blind member, means for guiding said roller blind member along an oblique area to be shaded, a motor-driven rotatably mounted winding shaft from and onto which said blind member may be wound, guide tracks at the ends of the winding shaft for sliding movement of the winding shaft, such tracks extending in the assembled state obliquely downward and a guide shoe element arrangement for limiting the displacement of the winding shaft downward owing to gravity, the roller blind member being guided along such guide shoe element arrangement toward the oblique area during unwinding of the roller blind member from the winding shaft;

wherein the guide shoe element arrangement comprises at least two disk-cam guide shoe elements arranged in the axial position of marginal parts of the winding shaft;

wherein the roller blind member is provided marginally with frictional elements for fixing its turns in relation to each other;

wherein the frictional elements do not axially overlap with the guide shoe element arrangement.

7. The roller blind drive device according to claim 6, wherein the frictional elements comprise toothed elements.

8. The roller blind drive device according to claim 6, wherein the roller blind member comprises hollow slats and wherein the frictional elements are formed as male elements able to be inserted into the hollow slats of the roller blind member.

9. The roller blind drive device according to claim 6, wherein the frictional elements are formed as frictional strip elements on the roller blind member.

10. The roller blind drive device according to claim 6, comprising at least one third guide shoe element being arranged in the axially middle part in case of long winding shafts.

11. A roller blind drive comprising a roller blind member, means for guiding said roller blind member along an oblique area to be shaded, a motor-driven rotatably mounted winding shaft from and onto which said blind member may be wound, guide tracks at the ends of the winding shaft for sliding movement of the winding shaft, such tracks extending in the assembled state obliquely downward and a guide shoe element arrangement for limiting the displacement of the winding shaft downward owing to gravity, the roller blind member being guided along such guide shoe element arrangement toward the oblique area during unwinding of the roller blind member from the winding shaft;

wherein the slope of the guide tracks may be adjusted in a manner dependent on the slope of the oblique area by means of a slope setting device;

wherein the guide tracks in the form of guide rails are pivotally mounted on holding elements, and wherein the holding elements include holding plates and rows of holes or of slots are provided in the holding elements for adjustment of the angle of slope of the guide tracks.

12. A roller blind drive comprising a roller blind member, means for guiding said roller blind member along an oblique area to be shaded, a motor-driven rotatable mounted winding shaft from and onto which said blind member may be wound, guide tracks at the ends of the winding shaft for sliding movement of the winding shaft, such tracks extending in the assembled state obliquely downward and a guide shoe element arrangement for limiting the displacement of the winding shaft downward owing to gravity, the roller blind member being guided along such guide shoe element arrangement toward the oblique area during unwinding of the roller blind member from the winding shaft;

wherein the guide shoe element arrangement comprises at least two disk-cam guide shoe elements in the axial position of the marginal parts of the winding shaft, at least one third guide shoe element preferably being arranged in the axially middle part in the case of long winding shafts;

wherein the roller blind member is provided marginally with frictional elements for fixing its turns in relation to each other; and wherein the frictional elements comprise an elastic material.

13. The roller blind drive device according to claim 12, wherein the roller blind member comprises hollow slats an wherein the frictional elements are formed as male elements able to be inserted into the hollow slats of the roller blind member.

* * * * *